US005221817A

United States Patent [19]

Ota

[11] Patent Number: 5,221,817

[45] Date of Patent: Jun. 22, 1993

[54] HEATING APPARATUS

[75] Inventor: Nobuaki Ota, Anjo, Japan

[73] Assignee: Kabushiki Kaisha Toshiba, Kanagawa, Japan

[21] Appl. No.: 830,630

[22] Filed: Feb. 4, 1992

[30] Foreign Application Priority Data

Feb. 8, 1991 [JP] Japan ..... 3-39339
Apr. 26, 1991 [JP] Japan ..... 3-125498

[51] Int. Cl.[5] ..... H05B 6/68

[52] U.S. Cl. ..... 219/10.55 B; 219/10.55 E; 219/492; 219/506; 99/325

[58] Field of Search ..... 219/10.55 R, 10.55 B, 219/10.55 F, 10.55 M, 10.55 E, 492, 506; 99/325

[56] References Cited

U.S. PATENT DOCUMENTS 4,309,584 1/1982 Terakami ..... 219/10.55 B
4,336,433 7/1982 Yokozeki ..... 219/10.55 B
4,396,817 8/1983 Eck et al. ..... 219/10.55 B
4,405,991 9/1983 Stanley ..... 219/10.55 R
4,418,262 11/1983 Noda ..... 219/10.55 B
4,499,357 2/1985 Kojima ..... 219/10.55 B
4,517,428 5/1985 Matsushima ..... 219/10.55 B
4,568,810 2/1986 Carmean ..... 219/10.55 B
4,780,588 10/1988 Edamura ..... 219/10.55 B
4,841,125 6/1989 Edamura .
4,920,246 4/1990 Aoki ..... 219/10.55 B
4,972,060 11/1990 Edamura ..... 219/10.55 B

FOREIGN PATENT DOCUMENTS

0264935A2 4/1988 European Pat. Off. .
0329111A3 8/1989 European Pat. Off. .
0366137A1 5/1990 European Pat. Off. .

*Primary Examiner*—Bruce A. Reynolds
*Assistant Examiner*—Tuan Vinh To
*Attorney, Agent, or Firm*—Limbach & Limbach

[57] ABSTRACT

A heating apparatus such as microwave ovens includes a microcomputer incorporating a first storage storing data of a plurality of cooking menus and corresponding cooking information and a second storage storing data of the order of priority of selection with respect to the cooking menus. The microcomputer has another storage storing data of the number of times of execution of the respective cooking menus. The microcomputer operates to add "1" to the number of times of execution of a cooking operation when the heating operation is executed in accordance with the selected cooking menu. The microcomputer determines the order of the number of times of execution of the cooking menus. The microcomputer renews the order of priority of selection of the cooking menus in accordance with the determined order of the number of times of execution of the cooking menus.

10 Claims, 11 Drawing Sheets 33a 32a

| | EXECUTION TIMES COUNTERS | | DISPLAYING ORDER MEMORIES | |
|---|---|---|---|---|
| | INITIAL VALUE | VALUE AFTER EXECUTION OF COOKING | INITIAL VALUE | VALUE AFTER EXECUTION OF COOKING |
| BOILED RICE | 0 | 18 | 1 | 2 |
| SIDE DISH | 0 | 25 | 2 | 1 |
| EDIBLE HERBS | 0 | 1 | 3 | 6 |
| ROOT VEGETABLES | 0 | 5 | 4 | 4 |
| BOILING | 0 | 11 | 5 | 3 |
| STEWING | 0 | 3 | 6 | 5 |

FIG.8

| | | BOILED RICE | SIDE DISH | EDIBLE HERBS | ROOT VEGETABLES | BOILING | STEWING |
|---|---|---|---|---|---|---|---|
| 33a | EXECUTION TIMES COUNTERS | 18 | 25 | 1 | 5 | 11 | 3 |
| 32a | DISPLAYING ORDER MEMORIES | 2 | 1 | 6 | 4 | 3 | 5 |

FIG.9(a)

| | | | | | | | |
|---|---|---|---|---|---|---|---|
| 33a | EXECUTION TIMES COUNTERS | 18 | 25 | 2 | 5 | 11 | 3 |
| 32a | DISPLAYING ORDER MEMORIES | 2 | 1 | 6 | 4 | 3 | 5 |

FIG.9(b)

| | | | | | | | |
|---|---|---|---|---|---|---|---|
| 33a | EXECUTION TIMES COUNTERS | 18 | 25 | 3 | 5 | 11 | 3 |
| 32a | DISPLAYING ORDER MEMORIES | 2 | 1 | 6 | 4 | 3 | 5 |

FIG.9(c)

| | | | | | | | |
|---|---|---|---|---|---|---|---|
| 33a | EXECUTION TIMES COUNTERS | 18 | 25 | 4 | 5 | 11 | 3 |
| 32a | DISPLAYING ORDER MEMORIES | 2 | 1 | 6 | 4 | 3 | 5 |

FIG.9(d)

| | | | | | | | |
|---|---|---|---|---|---|---|---|
| 33a | EXECUTION TIMES COUNTERS | 18 | 25 | 5 | 5 | 11 | 3 |
| 32a | DISPLAYING ORDER MEMORIES | 2 | 1 | 5 | 4 | 3 | 6 |

FIG.9(e)

33a 32a

| | EXECUTION TIMES COUNTERS | | DISPLAYING ORDER MEMORIES | |
|---|---|---|---|---|
| | MORNING | AFTERNOON | MORNING | AFTERNOON |
| BOILED RICE | 0 | 0 | 1 | 1 |
| SIDE DISH | 0 | 0 | 2 | 2 |
| EDIBLE HERBS | 0 | 0 | 3 | 3 |
| ROOT VEGETABLES | 0 | 0 | 4 | 4 |
| BOILING | 0 | 0 | 5 | 5 |
| STEWING | 0 | 0 | 6 | 6 |

FIG.11

HEATING APPARATUS

BACKGROUND OF THE INVENTION

This invention relates to a heating apparatus such as microwave ovens wherein one of a plurality of cooking menus is selected and food contained in a cooking chamber is heated by a magnetron or an electric heater in accordance with the selected cooking menu, thereby executing an automatic cooking.

The prior art has provided, for example, a microwave oven in which the heating operation is automatically executed in accordance with one of a plurality of predetermined cooking menus selected by operation of a key. More specifically, a microcomputer incorporating a memory previously storing data of cooking menus and data of pieces of cooking information corresponding to the respective cooking menus and including a heating time period, heating output level, heating temperature and/or the like. All of the cooking menus are displayed on a display simultaneously in a preselected order. Furthermore, a selection button switch and a start button switch are mounted in an operation panel. The selection button switch is operated so that each one of the cooking menus displayed on the display is specified sequentially from the top one. When the start button switch is operated in the condition that one of the cooking menus has been specified, the microcomputer inputs from the memory the cooking information corresponding to the specified cooking menu. The microcomputer then controls the heating output of a magnetron or an electric heater for the oven cooking in accordance with the input cooking information. Accordingly, the cooking can be executed in accordance with a desirable cooking menu just when it is selected from a plurality of cooking menus displayed on the display.

However, the order in which all of the cooking menus are simultaneously displayed on the display is previously determined. Accordingly, when a cooking menu having a high frequency of execution is given a lower order on the display, the selection button switch needs to be operated at a plurality of number of times every time that cooking menu is selected, resulting in a disadvantage that operating the selection button switch is troublesome.

In order to overcome the above-described disadvantage, it has been considered that the cooking menus are displayed in the order of an estimated frequency of execution. Generally, however, the frequency of execution of each cooking menu differs from home to home.

SUMMARY OF THE INVENTION

Therefore, an object of the present invention is to provide a heating apparatus wherein the cooking menu having a high frequency of execution can be readily selected from a plurality of cooking menus displayed on the display.

Another object of the invention is to provide a heating apparatus wherein the cooking menu having a high frequency of execution can be readily selected from a plurality of cooking menus displayed on the display irrespective of the time zones.

In one aspect, the present invention provides a heating apparatus comprising a cooking chamber for containing food to be cooked, heating means for heating the food contained in the cooking chamber to cook the same, first storage means for storing data of a plurality of cooking menus and respective pieces of cooking information corresponding to the respective cooking menus, second storage means having a plurality of storage areas corresponding to the respective data of the cooking menus stored in the first storage means, the second storage means being provided for storing data of the order of priority of selection with respect to the respective data of the cooking menus in the respective storage areas thereof, menu specifying means including at least one manually operated member and responsive to operation of the manually operated member for sequentially specifying the cooking menus, in the order of priority of selection whose data is stored in the second storage means, a display for displaying the cooking menus specified by the menu specifying means, cooking control means inputting, from the first storage means, the cooking information corresponding to the cooking menu specified by the menu specifying means, the cooking control means controlling an output power of the heating means based on the input cooking information, thereby executing the cooking, counter means having storage areas corresponding to the respective cooking menus whose data is stored in the first storage means, for storing data of the number of times of execution of the respective cooking menus, execution times renewal means for adding a predetermined value or "1" to the number of times of execution of a cooking operation whose data is stored in the storage area of the counter means corresponding to the selected cooking menu when the heating operation is executed under the control of the cooking control means in accordance with the selected cooking menu, cooking frequency determining means for determining the order of the number of times of execution of the cooking menus whose data are stored in the counter means, and selection priority order renewing means for renewing the order of priority of selection of the cooking menus stored in the second storage means in accordance with the order of the number of times of execution of the cooking menus determined by the cooking frequency determining means.

In accordance with the above-described heating apparatus, the cooking menus displayed on the display can be specified in the order of frequency of execution. Consequently, the operation for selecting the cooking menu can be simplified.

In another aspect, the invention provides a heating apparatus comprising cooking chamber for containing food to be cooked, heating means for heating the food contained in the cooking chamber to cook the same, first storage means for storing data of a plurality of cooking menus and respective pieces of cooking information corresponding to the respective cooking menus, second storage means having first and second storage areas corresponding to at least two different time zones, for each cooking menu whose data is stored in the first storage means, the first and second storage areas of the second storage means being provided for storing data of selection priority order with respect to the cooking menus whose data is stored in the first storage means, clock means for keeping the present time, menu specifying means including at least one manually operated member and responsive to operation of the manually operated member for sequentially specifying one of the cooking menus, in the selection priority order whose data is stored in either first or second storage area of the second storage means arranged to correspond to the time zone to which the present time kept by the clock means belongs, a display for displaying the cooking menu specified by the menu specifying means, cooking control means inputting the cooking information corresponding to the cooking menu specified by the menu specifying means, the cooking control means controlling an output power of the heating means based on the input cooking information, thereby executing the cooking, counter means having storage areas corresponding to the first and second storage areas of the second storage means, for storing data of the number of times of execution of the respective cooking menus, execution times renewal means for adding a predetermined value or "1" to the number of times of execution of a cooking operation whose data is stored in the storage area of the counter means corresponding to the selected cooking menu and to the time zone to which the present time kept by the clock means belongs, when the heating operation is executed under the control of the cooking control means in accordance with the selected cooking menu, cooking frequency determining means for determining the order of the number of times of execution of the cooking menus whose data are stored in the storage area of the counter means arranged to correspond to the time zone to which the present time kept by the clock means belongs, and selection priority order renewing means for renewing the order of priority of the cooking menus whose data are stored in the second storage means in accordance with the order of priority of the cooking menus determined by the cooking frequency determining means.

In accordance with the above-described heating apparatus, each one of the cooking menus displayed on the display can be specified in the order of frequency of execution in each of a plurality of time zones. For example, the time zones may correspond to breakfast, lunch and evening meal time zones. Consequently, the operation for selecting the cooking can be simplified irrespective of the time zones.

Other objects of the present invention will become obvious upon understanding of the illustrative embodiments about to be described. Various advantages not referred to herein will occur to one skilled in the art upon employment of the invention in practice.

BRIEF DESCRIPTION OF THE DRAWINGS

The embodiments of the present invention will be described with reference to the accompanying drawings in which:

FIG. 8 shows the contents of a counter and a memory in the case where each cooking menu has been executed at a plurality of times;

FIGS. 9(*a*) through 9(*e*) show changes in the contents of the counter and the memory in the case where one of the cooking menus is executed four times;

FIG. 11 shows arrangements of an execution times counter and a displaying order memory;

DESCRIPTION OF THE PREFERRED EMBODIMENTS

Figure 1:
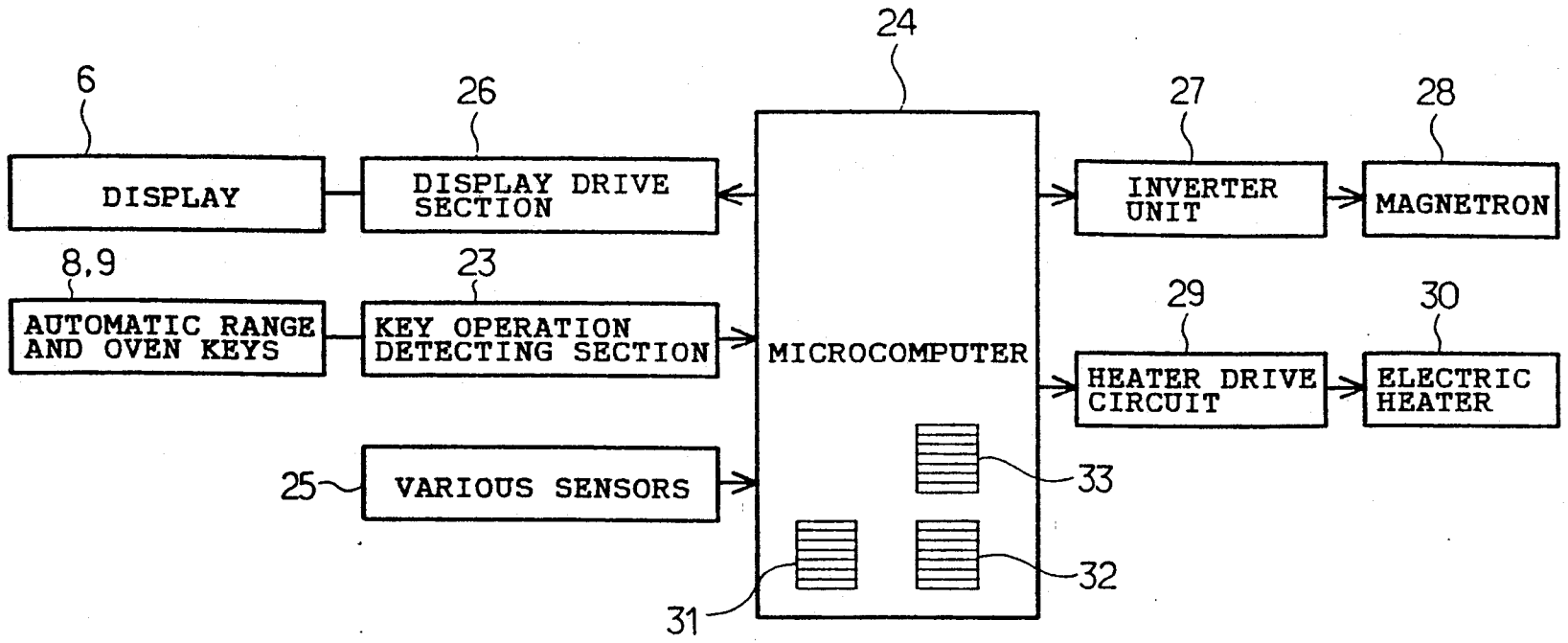
FIG. 1 is a block diagram showing an electrical arrangement of a microwave oven in accordance with one embodiment of the invention.

A first embodiment in which the invention is applied to a microwave oven will be described with reference to FIGS. 1 through 9. Referring to FIG. 2, a door 2 is mounted on the front side of a cabinet 1 of the microwave oven. A cooking chamber 4 is defined in the cabinet 1 and a turntable 3 is rotatably mounted in the cooking chamber 4. The door 2 is opened for access to the cooking chamber 4. An operation panel 5 is provided on the front side of the cabinet 1.

Figure 3:
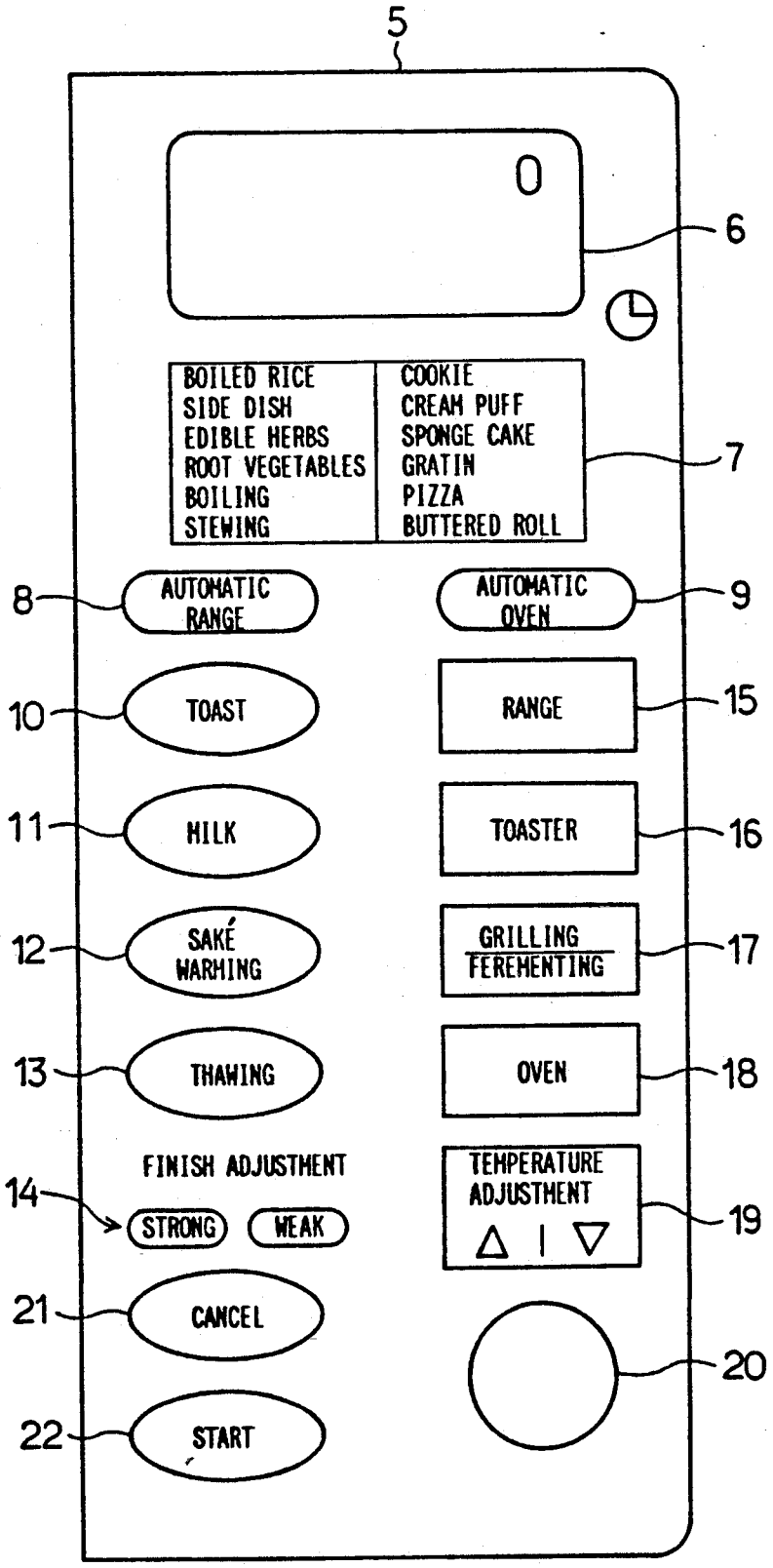
FIG. 3 is a front view of an operation panel of the microwave oven.

Referring to FIG. 3, the operation panel 5 includes two displays and various switches. A vacuum fluorescent display 6 is provided for displaying a heating period of time set for the cooking operation, a temperature set for the heating operation and the like. A liquid crystal display 7 is provided for displaying a range cooking menu group arranged in a row and an oven cooking menu group arranged in a row. The range cooking menu group includes a plurality of cooking menus for the high frequency heating and the oven cooking menu group includes a plurality of cooking menus for the oven heating.

An AUTOMATIC RANGE key 8 serving as a manually operated member is operated for specifying one of the cooking menus in the range cooking menu group. An AUTOMATIC OVEN key 9 also serving as a manually operated member is provided for specifying one of the cooking menus in the oven cooking menu group.

A TOAST key 10, MILK key 11, SAKÉ WARMING key 12 for warming Japanese saké and THAWING key 13 are operated for executing an automatic heating operation for respective objects to be heated or foods. A FINISH ADJUSTMENT key 14 is provided for fine control of the finished temperature of the food. A RANGE key 15, TOASTER key 16, GRILLING/FERMENTING key 17 and OVEN key 18 are provided for setting a heating function in the respective cooking menus. A TEMPERATURE ADJUSTING key 19 is provided for setting the temperature in the oven cooking. A COOKING PERIOD SETTING knob 20 is provided for setting a cooking period of time and a CANCEL key 21 is provided for canceling the set cooking condition or interrupting the cooking. A START key 22 is operated for starting the heating.

Figure 2:
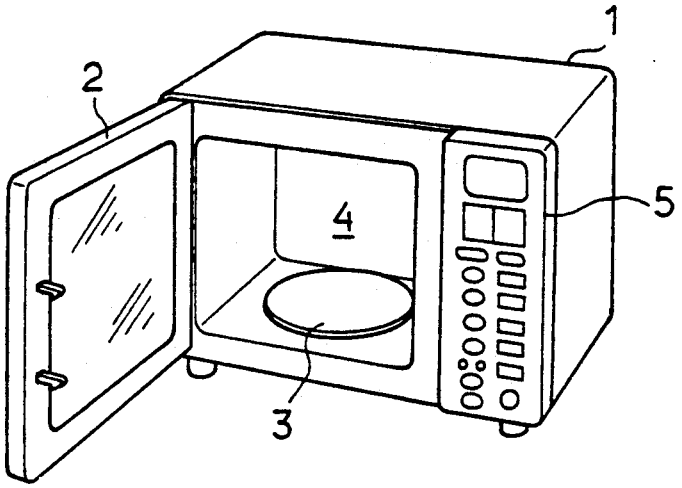
FIG. 2 is a perspective view of the microwave oven.

Referring to FIG. 1, a key operation detecting section 23 detects the state of the various operation switches on the operation panel 5 including the keys 8, 9. The state of each operation switch detected by the key operation detecting section 23 is delivered to a microcomputer 24. A sensor group 25 includes a gas sensor sensing gases emanating from the food to be cooked, a weight sensor sensing the weight of the food to be cooked on the turntable 3 and a temperature sensor sensing an atmospheric temperature in the cooking chamber 4, none of these sensors being shown in the drawings. The output of each sensor is delivered to the microcomputer 24.

Upon receipt of a display signal from the microcomputer 24, a display drive section 26 drives the vacuum fluorescent display 6 so that the heating time period and the heating temperature are displayed thereon and the liquid crystal display 7 so that the cooking menus are displayed thereon. An inverter unit 27 is responsive to a drive signal from the microcomputer 24 to apply a high voltage to a magnetron 28 serving as heating means in the condition that one range cooking menu has been selected. A heater drive circuit 29 is responsive to a drive signal from the microcomputer 24 to energize an electric heater 30 also serving as the heating means provided in the cooking chamber 4 in the condition that one oven cooking menu has been selected.

The microcomputer 24 operates to execute the cooking operation based on the states of the various switches detected by the key operation detecting section 23 and the state of the sensor group 25. The microcomputer 24 is provided with a read-only memory (ROM) 31 serving as a first storage means, a random access memory (RAM) 32 serving as a second storage means and another RAM 33 serving as a counter means. The microcomputer 24 operates to drive the magnetron 28 or the electric heater 30 based on data stored in RAMs 32, 33 and on the cooking information stored in ROM 31, thereby executing the heating operation. Furthermore, the microcomputer 24 operates to reload RAMs 32, 33 so that the data stored in each RAM is erased and new data is stored in each RAM.

Figure 4:
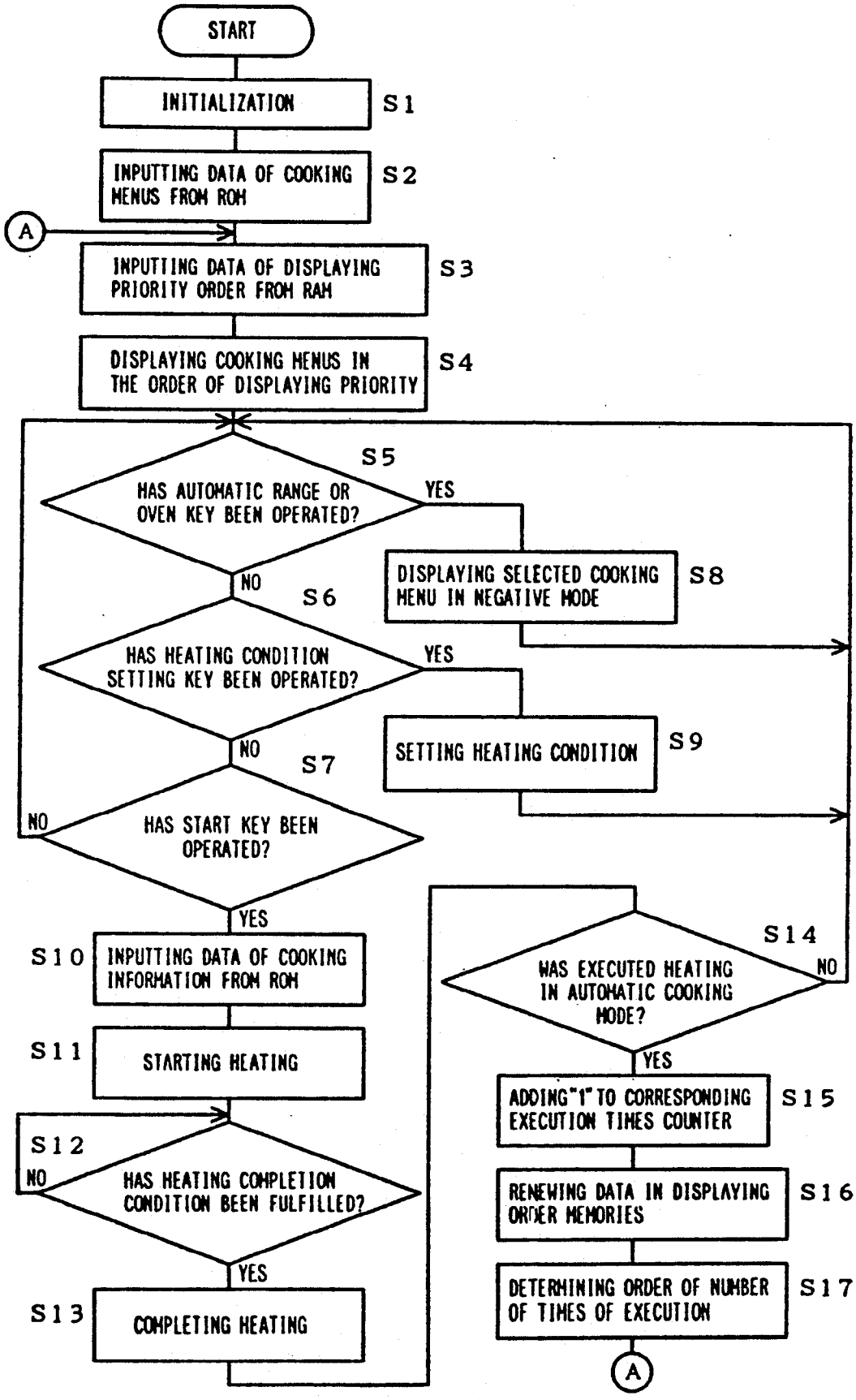
FIG. 4 is a flowchart showing the control manner of a microcomputer incorporated in the microwave oven.

The operation of the microwave oven will be described. Referring to FIG. 4, the microcomputer 24 executes an initializing operation at step S1 when electrical power is supplied to the same. More specifically, RAM 32 of the microcomputer 24 includes a plurality of storage areas or displaying order memories 32*a* corresponding to the respective cooking menus of the range cooking menu group and the respective cooking menus of the oven cooking menu group, as shown in FIG. 8. Furthermore, RAM 33 has a plurality of storage areas or execution times counters 33*a* corresponding to the respective cooking menus of the range cooking menu group and the respective cooking menus of the oven cooking menu group, as shown in FIG. 8. The microcomputer 24 executes the initializing operation, writing initial values of the displaying order memories 32*a* and the execution times counters 33*a* corresponding to the respective cooking menus, as shown in FIG. 8. Consequently, "0" is stored in each execution times counter 33*a* and numerals "1" through "6" indicative of the priority order are stored in the respective execution times memories 32*a*. FIG. 8 shows the displaying order memories 32*a* and the execution times counters 33*a* only for the range cooking menu group and those for the oven cooking menu group is eliminated.

The microcomputer 24 then inputs data of the cooking menus from ROM 31 at step S2 and further inputs data of the order of priority of displaying from RAM 32 at step S3. The data of the order of priority of displaying is then displayed on the liquid crystal display 7, that is, the cooking menus are lined in a row such that the cooking menu corresponding to the smallest numeral whose data is stored in the displaying order memory 32*a* of RAM 32 is at the first place and the cooking menu corresponding to the largest numeral occupies the tail end. Consequently, the range and oven cooking menu groups are displayed on the liquid crystal display 7 in the order of priority of displaying as shown in FIG. 3.

Figure 5:
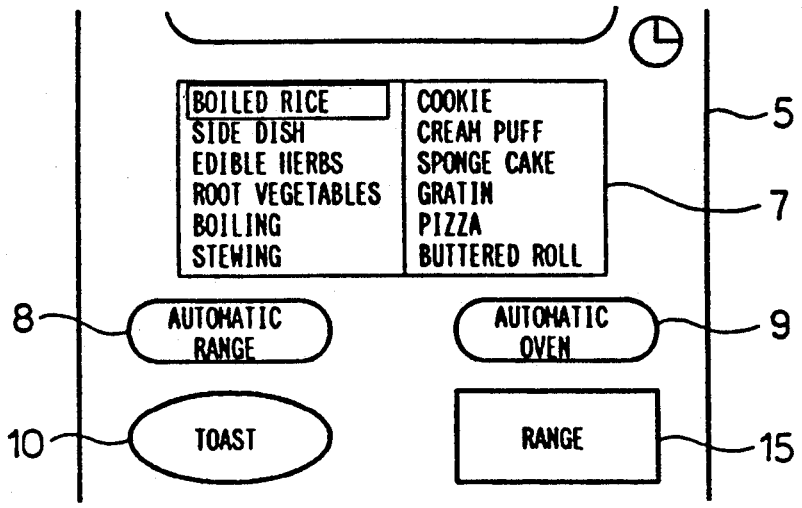
FIG. 5 is a front view of a display displaying cooking menus with the first one specified.
Figure 6:
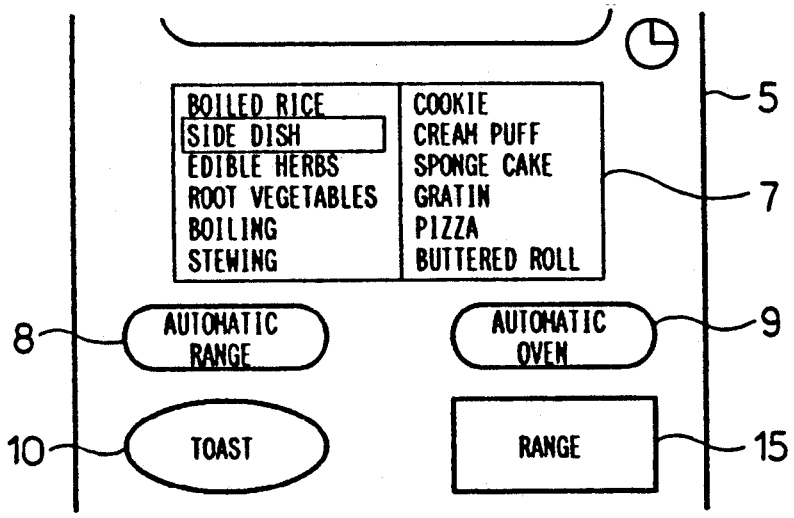
FIG. 6 is a front view of the display displaying the cooking menus with the second one specified.

The microcomputer 24 is then on standby for a key operation in steps S5 to S7. Subsequently, when either the AUTOMATIC RANGE key 8 or the AUTOMATIC OVEN key 9 is operated, the display mode of one of the cooking menus in either the range or oven cooking menu group displayed on the display 7 is inverted from the positive to the negative, at step S8. More specifically, when the AUTOMATIC RANGE key 8 is operated once, for example, the display mode of "boiled rice" given the top priority in the range cooking menu group is inverted from the positive to the negative state, as shown in FIG. 5. When the AUTOMATIC RANGE key 8 is operated twice continuously, the display mode of "side dishes" given the second priority in the range cooking menu group is inverted from the positive to the negative, as shown in FIG. 6. Also, when the AUTOMATIC OVEN key 9 is operated, the display mode of one of the cooking menus in the oven cooking menu group on the display 7 is inverted from the positive to the negative. When any heating condition setting key other than the AUTOMATIC RANGE and OVEN keys 8, 9 are operated, the microcomputer 24 advances from step S6 to step S9 to set the corresponding heating condition.

When the START key 22 is operated in the condition that one of the cooking menus is selected, the microcomputer 24 advances from step S7 to step S10 to input from ROM 31 the cooking information corresponding, for example, to "side dishes" in the negative display mode and starts the heating operation based on the input cooking information and the outputs of various sensors at step S11. When the microcomputer 24 determines at step S12 that the condition of completion of the heating has been fulfilled, the heating operation is completed at step S13.

Figure 7:
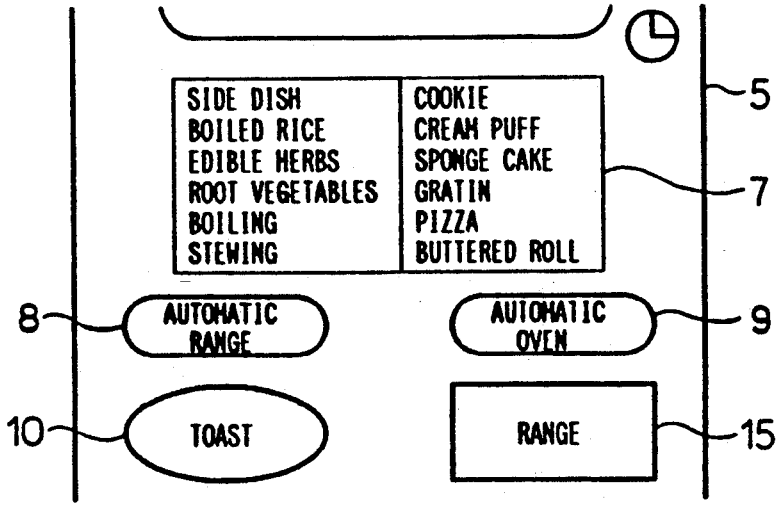
FIG. 7 is a front view of the display in the state that the specified first menu shown in FIG. 5 is selected.

Subsequently, when the executed heating operation was in an automatic cooking mode by selection of any one of the cooking menus in either the range or oven cooking menu group, a predetermined numerical value or "1" is added to the data stored in the execution times counter 33*a* corresponding to the selected cooking menu, at step S15 and the microcomputer 24 determines the order of priority of the selected cooking menu based on the number of times of execution stored in the execution times counter 33*a*, at step S16. The microcomputer 24 then renews the contents of the displaying order memories 32*a* in accordance with the order of times of execution of the cooking menus, which number of times corresponds to a count value of the execution times counter 33*a*, at step S17. In this case, since the cooking menu, "side dishes" has been selected, "1" is added to the number of times of execution whose data is stored in the execution times counter 33*a* corresponding to that cooking menu. Consequently, the number of times of execution whose data is stored in the execution times counter 33*a* corresponding to the selected cooking menu is increased from "0" to "1" with the number of times of execution whose data is stored in the other counters 33*a* remaining unchanged. Accordingly, the number of times of execution whose data is stored in the execution times counter 33*a* corresponding to "side dishes" becomes the largest. The microcomputer 24 then renews the contents of the displaying order memory 32*a* corresponding to "side dishes" from "2" to "1" and that of the displaying order memory 32*a* corresponding to "boiled rice" from "1" to "2." Returning to step S3, the microcomputer 24 operates to display, on the liquid crystal display 7, the cooking menus in the order of priority of displaying whose data is stored in the displaying order memories 32*a* of RAM 32. Consequently, the cooking menu, "side dishes" is displayed at the top place and "boiled rice" follows it, as shown in FIG. 7. The above-described renewal of the values stored in the execution times counter 33*a* and the displaying order memories 32*a* is performed every time the automatic mode cooking menu is selected and completed. FIG. 8 shows the changes of the data of values stored in the execution times counters 33*a* and the displaying order memories 32*a* when the automatic mode cooking menu is executed at a number of times.

When a cooking menu assigned a small number of times of execution whose data is stored in the execution times counter 33*a* is executed several times continuously in a short period of time, the number of times of execution of that cooking menu transiently exceeds that of the cooking menu usually assigned a large number of times of execution. Should the cooking menus be displayed in the order of number of times of execution stored in the counters 33*a* in this case, the cooking menu with a usual low frequency of execution would be displayed in a rank higher than that with a usual high frequency of execution. To solve this problem, the microcomputer 24 operates not to perform the renewal of the displaying order of the cooking menus when an executed cooking menu is continuously selected. More specifically, when an executed cooking menu is the same as was executed last time, the microcomputer 24 returns to step S4 without performing steps S16 and S17. Accordingly, when one and the same cooking menu is executed continuously, "1" is added to the numerical value of the execution times counter 33*a* corresponding to the executed cooking menu but the order of the cooking menus displayed does not reflect this increase of the value. However, when one and the same cooking menu is executed continuously at a predetermined number of times, it is desirable that the order of the cooking menus displayed should reflect the continuous execution of the cooking menu at the predetermined number of times. Thus, when one and the same cooking menu is executed continuously at a predetermined number of time or more, the microcomputer 24 performs steps S16 and S17 so that the order of the cooking menus displayed reflects the numerical values stored in the respective execution times counters 33*a*.

FIGS. 9(*a*)–9(*e*) show the changes of the values whose data are stored in the execution times counters 33*a* and the displaying order memories 32*a* when the cooking menu, "edible herbs" assigned the smallest number of times of execution is executed continuously at several times in the state shown in FIG. 8. More specifically, when the cooking menu, "edible herbs" whose number of times of execution is 1 is executed continuously at three times, the number of times of execution of that cooking menu is increased to 4, which value exceeds that of the cooking menu, "stewing" or 3. However, the microcomputer 24 operates not to change the displaying order of the cooking menus based on the number of times of execution of each cooking menu, as shown in FIG. 9(*d*). When the cooking menu "edible herbs" is executed continuously four times, the microcomputer 24 operates to change the displaying order so that "stewing" is replaced by "edible herbs," as shown in FIG. 9(*e*).

Eight-bit execution times counters 33*a* are provided in RAM 33 of the microcomputer 24, for example. When any one of the cooking menus is executed at two hundred and fifty-five times from the initial state or when all of the bits become high, all of the execution times counters 33*a* corresponding to the respective cooking menus are shifted one bit to a lower one. Consequently, the value stored in each execution times counter 33*a* is reduced to its half and the number of times of execution of each counter 33*a* can be recounted.

In accordance with the above-described embodiment, the data of the number of times of execution of each cooking menu is stored in each execution times counter 33*a* of RAM 33 every time one of the cooking menus is selected and executed. The order of cooking menus displayed on the liquid crystal display 7 is changed in the order of times of execution stored in the counter 33*a*. Consequently, the cooking menus are displayed on the liquid crystal display 7 in the order of number of times of execution theretofore though the cooking menus have been displayed in a fixed order in the prior art. Thus, the operation of each AUTOMATIC key 8, 9 can be simplified when the cooking menu assigned a high frequency of execution is executed.

Figure 10:
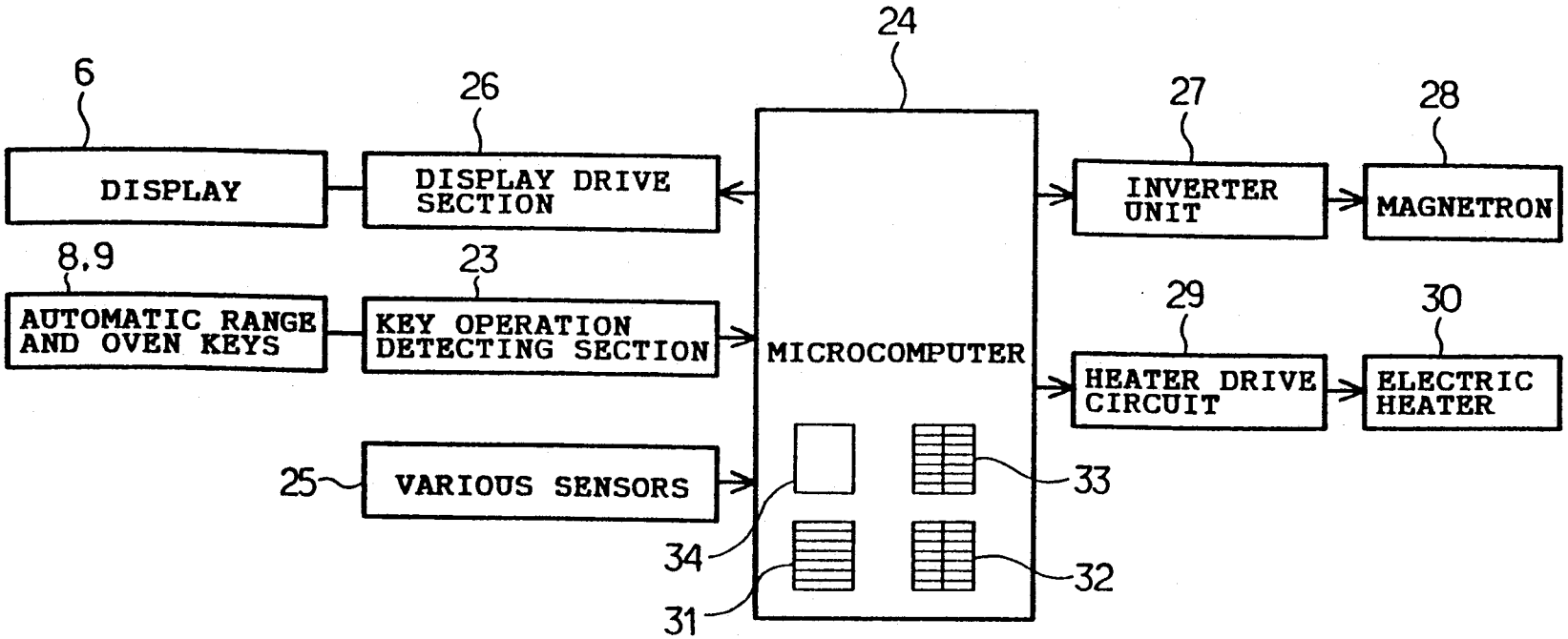
FIG. 10 is a block diagram showing the electrical arrangement of the microwave oven in accordance with a second embodiment.

FIGS. 10 through 13 illustrate a second embodiment of the invention. The same reference numerals are used to designate like or similar parts in the first embodiment, and the difference between the first and second embodiments will be described. Referring to FIG. 10 showing an electrical arrangement of the microwave oven, the displaying order memories 32*a* and the execution times counters 33*a* are arranged in the form of a matrix in the respective RAMs 32, 33 of the microcomputer 24. Referring to FIG. 11, each displaying order memory 32*a* of RAM 32 has two storage areas for two time zones, the morning and the afternoon, respectively. Also, each execution times counter 33*a* of RAM 33 has two storage areas for two times zones, the morning and the afternoon, respectively. Initial values of the displaying order as shown in FIG. 11 are stored in the respective storage areas of the displaying order memories 32*a* of RAM 32 and initial values of the number of times of execution as shown in FIG. 11 are stored in the respective storage areas of the execution times counters 33*a* of RAM 33. The microcomputer 24 is provided with a clock circuit 34 serving as clock means. The clock circuit 34 keeps the present time.

Figure 12:
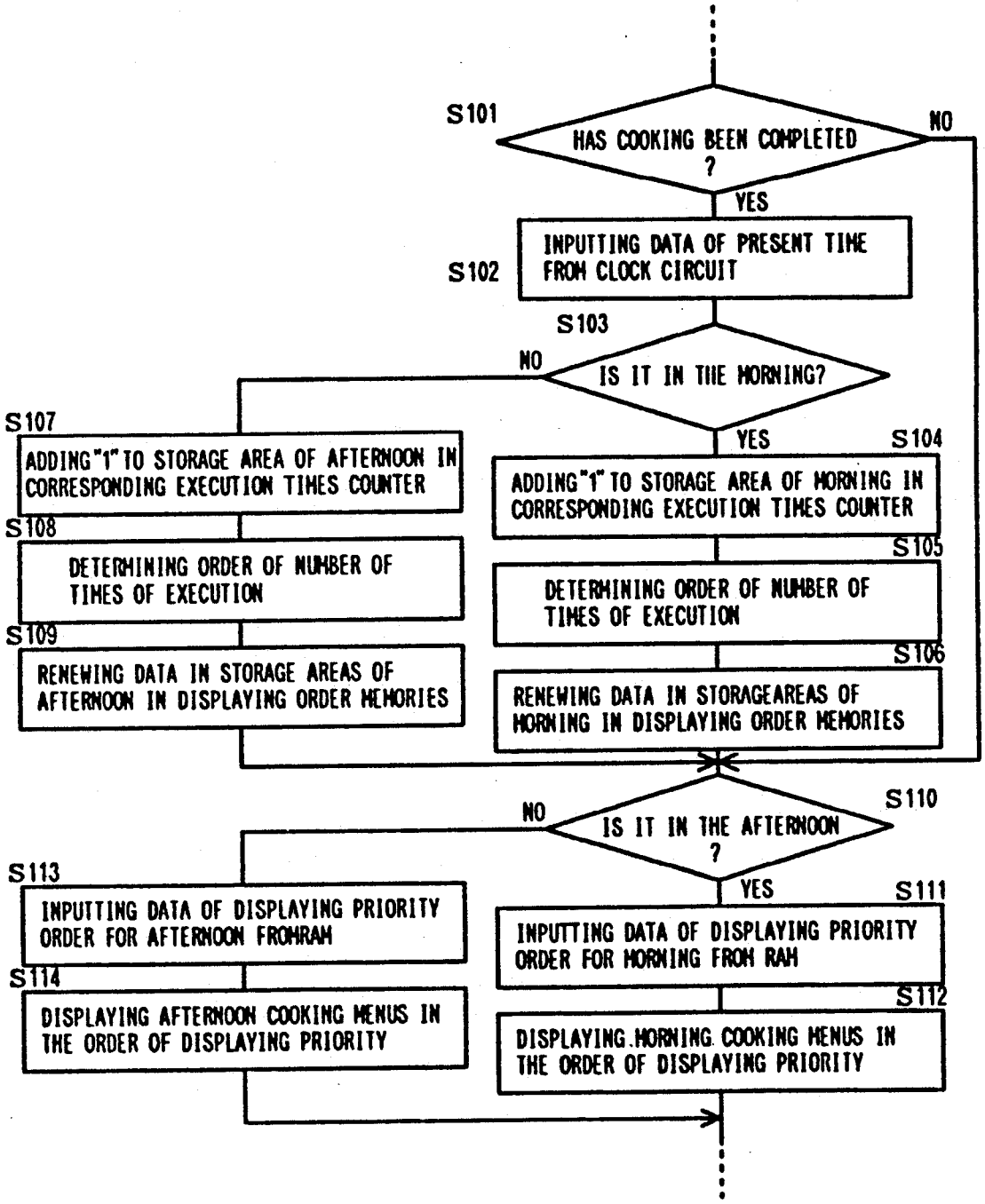
FIG. 12 is a flowchart showing the major control manner of the microcomputer.

Referring to FIG. 12, the microcomputer 24 reads in the present time from the clock circuit 34 at step 102 when the cooking is completed. Based on the present time, the microcomputer 24 determines whether it is in the morning or in the afternoon, at step S103. When determining that it is in the morning, the microcomputer 24 operates to add "1" to the data stored in the storage area for the morning in the execution times counter 33*a* corresponding to the executed cooking menu, at step S105. Furthermore, the microcomputer 24 operates to renew the contents of the displaying order memories 32*a* of RAM 32 in accordance with the order of number of times of execution, at step S106. When determining that it is in the afternoon, the microcomputer 24 operates to add "1" to the data stored in the storage area for the afternoon in the execution times counter 33*a* corresponding to the executed cooking menu, at step S107 and then determines the order of number of times of execution whose data is stored in the execution times counters 33*a*, at step S108. The microcomputer 24 then operates to renew the contents of the displaying order memories 32*a* in RAM 32 in accordance with the order of number of times of execution, at step S109.

Figure 13:
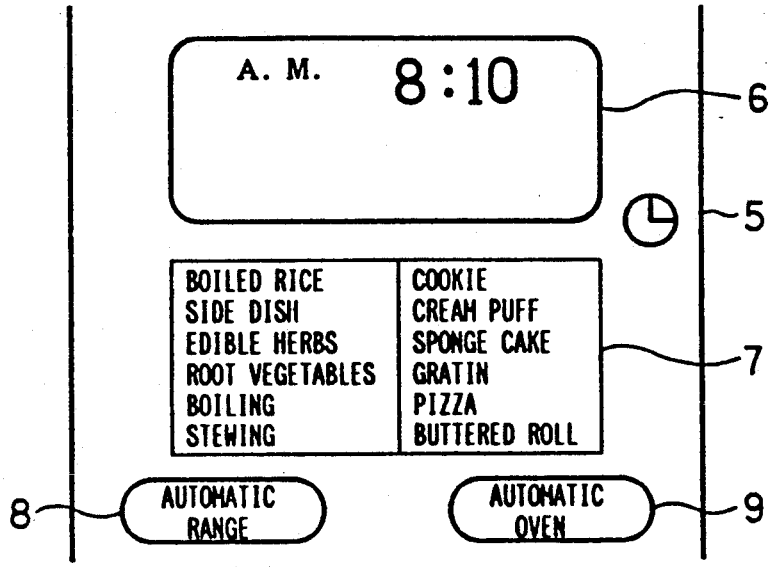
FIG. 13 is a view similar to FIG. 5 showing an example of displayed contents in the morning.
Figure 14:
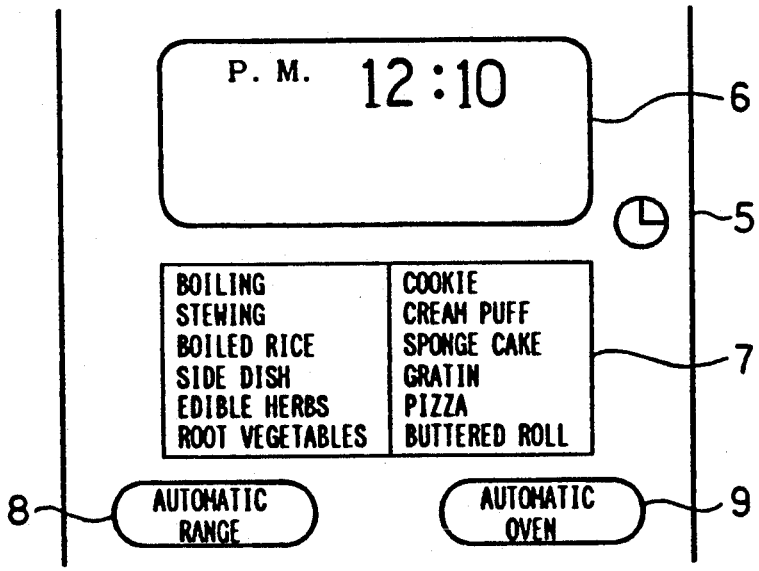
FIG. 14 is a view similar to FIG. 5 showing an example of displayed contents in the afternoon.

Advancing from step S110 to step S111 when it is determined that it is in the morning, the microcomputer 24 inputs from RAM 32 the data of the order of priority of displaying stored in the storage area for the morning in the displaying order memory 32*a* and further to display the morning cooking menus in the order of priority of displaying, at step S112. Furthermore, when determining that it is in the afternoon, the microcomputer 24 advances from step S110 to step S113 where the microcomputer 24 inputs from RAM 32 the data of the order of priority of displaying stored in the storage area for the afternoon in the displaying order memories 32*a* and operates to display the afternoon cooking menus, at step S114. Accordingly, the order of the cooking menus displayed in the morning as shown FIG. 13 is changed to that shown in FIG. 14 in the afternoon.

In accordance with the above-described second embodiment, RAMs 32, 33 store the data of the order of priority of displaying and the number of times of execution of the cooking menus in accordance with the time zones, the afternoon and the morning. Furthermore, the order of displaying of the cooking menus is changed in the morning and the afternoon. Consequently, the cooking menu assigned a high frequency of execution can readily selected in each time zone, the morning and afternoon.

Although the storage areas corresponding to the morning and afternoon are provided in each RAM 32, 33 in the second embodiment, each RAM 32, 33 may be provided with the storage areas corresponding to three or more time zones and the order of displaying of the cooking menus may be changed in the order of number of times of execution in each time zone.

Although the cooking menus are displayed on the display 7 in the order of frequency of execution and are selected sequentially from the top place in that order in the foregoing embodiments, the order of the cooking menus displayed on the display 7 may be fixed and may be specified in the order of frequency of execution of the cooking menus in response to operation of each AUTOMATIC key 8,9.

The foregoing disclosure and drawings are merely illustrative of the principles of the present invention and are not to be interpreted in a limiting sense. The only limitation is to be determined from the scope of the appended claims.

I claim:

1. A heating apparatus comprising:

a) a cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having a plurality of storage areas corresponding to a respective data of the cooking menus stored in the first storage means, the second storage means being provided for storing data of an order of priority of selection with respect to the respective data of the cooking menus in the respective storage areas thereof;

e) menu specifying means including at least one manually operated member and responsive to operation of the manually operated member for sequentially specifying the cooking menus in the order of priority of selection whose data is stored in the second storage means;

f) a display for displaying the cooking menus specified by the menu specifying means;

g) cooking control means inputting, from the first storage means, the cooking information corresponding to the cooking menu specified by the menu specifying means, the cooking control means controlling an output power of the heating means based on the input cooking information, thereby executing the cooking;

h) counter means having storage areas corresponding to the respective cooking menus whose data is stored in the first storage means, for storing data of a number of times of execution of the respective cooking menus;

i) execution times renewal means for adding a predetermined value or "1" to the number of times of execution of a cooking operation whose data is stored in the storage area of the counter means corresponding to the selected cooking menu when the heating operation is executed under the control of the cooking control means in accordance with the selected cooking menu;

j) cooking frequency determining means for determining the order of the number of times of execution of the cooking menus whose data are stored in the counter means; and k) selection priority order renewing means for renewing the order of priority of selection of the cooking menus stored in the second storage means in accordance with the order of the number of times of execution of the cooking menus determined by the cooking frequency determining means.

2. A heating apparatus comprising:

a) a cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having a plurality of storage areas corresponding to the respective cooking menus stored in the first storage means, the second storage means being provided for storing data of an order of priority of displaying with respect to the respective cooking menus in the respective storage areas;

e) a display for displaying the cooking menus;

f) menu display control means for controlling the display so that all of the cooking menus whose data is stored in the first storage means are displayed on the display in the order of priority of displaying whose data is stored in the respective storage areas of the second storage means;

g) menu specifying means including at least one manually operated member and responsive to operation of the manually operated member for specifying one of the cooking menus displayed on the display sequentially from a head one;

h) cooking control means inputting, from the first storage means, the cooking information corresponding to the cooking menu specified by the menu specifying means, the cooking control means controlling an output power of the heating means based on the input cooking information, thereby executing the cooking;

i) counter means having storage areas corresponding to the respective cooking menus whose data is stored in the first storage means, for storing data of a number of times of execution of the respective cooking menus;

j) execution times renewal means for adding a predetermined value or "1" to the number of times of execution of a cooking operation whose data is stored in the storage area of the counter means corresponding to the selected cooking menu when the heating operation is executed under the control of the cooking control means in accordance with the selected cooking menu;

k) cooking frequency determining means for determining an order of the number of times of execution of the cooking menus whose data are stored in the counter means; and l) displaying priority order renewing means for renewing the order of priority of the displaying of the cooking menus stored in the second storage means in accordance with the order of the number of times of execution of the cooking menus determined by the cooking frequency determining means.

3. A heating apparatus comprising:

a) cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having first and second storage areas corresponding to at least two different time zones, for each cooking menu whose data is stored in the first storage means, the first and second storage areas of the second storage means being provided for storing data of selection priority order with respect to the cooking menus whose data is stored in the first storage means;

e) clock means for keeping a present time;

f) menu specifying means including at least one manually operated number and responsive to operation of the manually operated member for sequentially specifying one of the cooking menus in the selection priority order whose data is stored in either first or second storage area of the second storage means arranged to correspond to the time zone to which the present time kept by the clock means belongs;

g) a display for displaying the cooking menu specified by the menu specifying means;

h) cooking control means inputting the cooking information corresponding to the cooking menu specified by the menu specifying means, the cooking control means controlling an output power of the heating means based on the input cooking information, thereby executing the cooking;

i) counter means having storage areas corresponding to the first and second storage areas of the second storage means, for storing data of a number of times of execution of the respective cooking menus;

j) execution times renewal means for adding a predetermined value or "1" to the number of times of execution of a cooking operation whose data is stored in the storage area of the counter means corresponding to the selected cooking menu and to the time zone to which the present time kept by the clock means belongs, when a heating operation is executed under the control of the cooking control means in accordance with the selected cooking menu;

k) cooking frequency determining means for determining the order of the number of times of execution of the cooking menus whose data are stored in the storage area of the counter means arranged to correspond to the time zone to which the present time kept by the clock means belongs; and l) selection priority order renewing means for renewing the order of priority of the cooking menus whose data are stored in the second storage means in accordance with the order of priority of the cooking menus determined by the cooking frequency determining means.

4. A heating apparatus according to claim 3, wherein the time zones include at least three time zones in which times of the breakfast, lunch and evening meal are respectively included.

5. A heating apparatus according to claim 3, wherein the time zones include a morning time zone and an afternoon time zone.

6. A heating apparatus comprising:

a) cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having first and second storage areas corresponding to at least two different time zones, for each cooking menu whose data is stored in the first storage means, the first and second storage areas of the second storage means being provided for storing data of selection priority order with respect to the cooking menus whose data is stored in the first storage means;

e) a display for displaying the cooking menus;

f) clock means for keeping a present time;

g) menu display control means for controlling the display so that the cooking menus whose data are stored in the first storage means are displayed on the display in the displaying priority whose data is stored in either first or second storage area of the second storage means arranged to correspond to the time zone to which the present time kept by the clock means belongs;

h) menu specifying means including at least one manually operated member and responsive to operation of the the manually operated member for specifying the cooking menus displayed on the display sequentially from a head one;

i) cooking control means inputting, from the first storage means, the cooking information corresponding to the cooking menu specified by the menu specifying means, the cooking control means controlling an output power of the heating means based on the input cooking information, thereby executing the cooking;

j) counter means having a plurality of storage areas corresponding to the first and second storage areas of the second storage means and arranged to correspond to a respective time zones, for storing data of a number of times of execution of the respective cooking menus;

k) execution times renewal means for adding a predetermined value or "1" to the number of times of execution of a cooking operation whose data is stored in the storage area of the counter means corresponding to a selected cooking menu and to the time zone to which the present time kept by the clock means belongs, when the heating operation is executed under the control of the cooking control means in accordance with the selected cooking menu;

l) cooking frequency determining means for determining the order of the number of times of execution of the cooking menus whose data are stored in the storage area of the counter means arranged to correspond to the time zone to which the present time kept by the clock means belongs; and m) displaying priority renewing means for renewing a displaying priority order of the cooking menus whose data are stored in the second storage means in accordance with a order of the number of times of execution of the cooking menus determined by the cooking frequency determining means.

7. A heating apparatus according to claim 6, wherein the time zones include a morning time zone and an afternoon time zone.

8. A heating apparatus according to claim 6, wherein the time zones include at least three time zones in which times of the breakfast, lunch and evening meal are respectively included.

9. A heating apparatus comprising:

a) a cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having a plurality of storage areas corresponding to a respective data of the cooking menus stored in the first storage means, the second storage means being provided for storing data of an order of priority of selection with respect to the respective data of the cooking menus in the respective storage areas thereof;

e) menu specifying means including at least one manually operated member and responsive to operation of the manually operated member for sequentially specifying the cooking menus in the order of priority of selection whose data is stored in the second storage means;

f) a display for displaying the cooking menus specified by the menu specifying means;

g) cooking control means inputting, from the first storage means, the cooking information corresponding to the cooking menu specified by the menu specifying means, the cooking control means controlling an output power of the heating means based on the input cooking information, thereby executing the cooking;

h) counter means having storage areas corresponding to the respective cooking menus whose data is stored in the first storage means, for storing data of a number of times of execution of the respective cooking menus;

i) execution times renewal means for adding a predetermined value or "1" to the number of times of execution of a cooking operation whose data is stored in the storage area of the counter means corresponding to the selected cooking menu when the heating operation is executed under the control of the cooking control means in accordance with the selected cooking menu;

j) cooking frequency determining means for determining the order of the number of times of execution of the cooking menus whose data are stored in the counter means;

k) selection priority order renewing means for renewing the order of priority of selection of the cooking menus stored in the second storage means in accordance with the order of the number of times of execution of the cooking menus determined by the cooking frequency determining means; and l) operation selecting means prohibiting operation of at least one of the cooking frequency determining means and the selection priority order renewing means when the cooking menu specified by the menu specifying means is the same as the cooking menu specified last time by the menu specifying means, the operation selecting means canceling prohibition of operation of at least one of the cooking frequency determining means and a selection priority order renewing means when one and the same cooking menu is specified continuously at a predetermined number of times by the menu specifying means.

10. A heating apparatus comprising:

a) a cooking chamber for containing food to be cooked;

b) heating means for heating the food contained in the cooking chamber;

c) first storage means for storing data of a plurality of cooking menus and respective pieces of cooking information corresponding to the respective cooking menus;

d) second storage means having a plurality of storage areas corresponding to the respective cooking menus stored in the first storage means, the second storage means being provided for storing data of an order of priority of displaying with respect to the respective cooking menus in the respective storage areas;

e) a display for displaying the cooking menus;

f) menu display control means for controlling the display so that all of the cooking menus whose data is stored in the first storage means are displayed on the display in the order of priority of displaying whose data is stored in the respective storage areas of the second storage means;

g) menu specifying means including at least one manually operated member and responsive to operation of the manually operated member for specifying one of the cooking menus displayed on the display sequentially from a head one;

h) cooking control means inputting, from the first storage means, the cooking information corresponding to the cooking menu specified by the menu specifying means, the cooking control means controlling an output power of the heating means based on the input cooking information, thereby executing the cooking;

i) counter means having storage areas corresponding to the respective cooking menus whose data is stored in the first storage means, for storing data of a number of times of execution of the respective cooking menus;

j) execution times renewal means for adding a predetermined value or "1" to the number of times of execution of a cooking operation whose data is stored in the storage area of the counter means corresponding to the selected cooking menu when the heating operation is executed under the control of the cooking control means in accordance with the selected cooking menu;

k) cooking frequency determining means for determining the order of the number of times of execution of the cooking menus whose data are stored in the counter means;

l) displaying priority order renewing means for renewing an order of priority of the displaying of the cooking menus stored in the second storage means in accordance with the order of the number of times of execution of the cooking menus determined by the cooking frequency determining means; and m) operation selecting means prohibiting operation of at least one of the cooking frequency determining means and a selection priority order renewing means when the cooking menu specified by the menu specifying means is the same as the cooking menu specified last time by the menu specifying means, the operation selecting means cancelling prohibition of operation of at least one of the cooking frequency determining means and the selection priority order renewing means when one and the same cooking menu is specified continuously at a predetermined number of times by the menu specifying means.

* * * * *